US006744221B2

(12) United States Patent
Choi et al.

(10) Patent No.: US 6,744,221 B2
(45) Date of Patent: Jun. 1, 2004

(54) ELECTRODELESS LIGHTING SYSTEM AND BULB THEREFOR

(75) Inventors: Joon-Sik Choi, Seoul (KR); Yong-Seog Jeon, Gwangmyeong (KR); Hyo-Sik Jeon, Gwangmyeong (KR); Hyun-Jung Kim, Seoul (KR); Ji-Young Lee, Gwangmyeong (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/207,999

(22) Filed: Jul. 31, 2002

(65) Prior Publication Data

US 2003/0132719 A1 Jul. 17, 2003

(30) Foreign Application Priority Data

Jan. 17, 2002 (KR) ..... 2002-02807

(51) Int. Cl.[7] ..... H05B 41/24; H01J 17/26

(52) U.S. Cl. ..... 315/248; 313/231.61

(58) Field of Search ..... 315/248, 291, 315/39, 236, 267, 344, 363, 5.13; 313/231.31, 231.41, 231.61, 231.71; 333/87 B; H05B 41/24; H01J 17/26

(56) References Cited

U.S. PATENT DOCUMENTS

| | | | | | |
|---|---|---|---|---|---|
| 4,645,967 | A | * | 2/1987 | Bouman et al. | 313/248 |
| 4,727,294 | A | * | 2/1988 | Houkes et al. | 315/248 |
| 5,847,517 | A | * | 12/1998 | Ury et al. | 315/248 |
| 2002/0105276 | A1 | * | 8/2002 | Jeon | 315/5.13 |
| 2002/0140381 | A1 | * | 10/2002 | Golkowski et al. | 315/363 |
| 2003/0141828 | A1 | * | 7/2003 | Choi et al. | 315/248 |

* cited by examiner

*Primary Examiner*—Don Wong
*Assistant Examiner*—Trinh Vo Dinh
(74) *Attorney, Agent, or Firm*—Birch, Stewart, Kolasch & Birch, LLP

(57) ABSTRACT

An electrodeless lighting system, including a waveguide having an outlet which is installed being protruded from the inside of a casing to the outside of the casing, for transmitting a microwave generated in the magnetron, a resonator fixed at the outer side of the outlet of the waveguide, for forming a resonant region in which the microwave is resonated, a bulb for generating light as plasma is generated by an electric field which is formed inside the resonator and a lighting promoting means positioned inside the bulb, for concentrating the electric field so that light is rapidly emitted when the microwave is applied, can achieve convenience of a user and increase reliability of lighting as the bulb rapidly emits light.

16 Claims, 4 Drawing Sheets

ELECTRODELESS LIGHTING SYSTEM AND BULB THEREFOR

BACKGROUND OF THE INVENTION

1. Field of the Invention

The present invention relates to an electrodeless lighting system and a bulb therefor and particularly, to an electrodeless lighting system and a bulb therefor, capable of emitting light in case of re-lighting.

2. Description of the Background Art

Generally, an electrodeless lighting system is a device for emitting visible rays or ultraviolet rays by applying microwave to an electrodeless lamp, as a microwave generated in a magnetron is transmitted to a resonator though a waveguide and applied to an electrodeless bulb installed inside the resonator and filled material which is filled in the bulb is plasma polymerized. Therefore, the system has longer life span than that of incandescent lamp or fluorescent lamp which is generally used, and has higher lighting effect.

An example of the electrodeless lighting system will be described with reference to FIGS. 1 and 2.

FIG. 1 is a longitudinal cross-sectional view showing a general electrodeless lighting system according to the conventional art and FIG. 2 is a partial cut-away detailed view of a bulb in FIG. 1.

The conventional electrodeless lighting system includes a casing 10, a high voltage generator 20 positioned on the inner front surface of the casing 10 for generating high voltage, a magnetron 30 positioned at a predetermined interval from the high voltage generator 20, for generating microwave by the high voltage generated in the high voltage generator 20, a waveguide 40 fixed on the front surface of the casing 10 and protruded to the outside of the casing 10, for guiding the microwave generated from the magnetron 30, a resonator 50 installed at the front outer side of the casing 10 so that it is connected with the waveguide 40, for resonating the microwave guided through the waveguide 40 and at the same time, preventing leakage of microwave to the outside, a bulb 60 mounted to be capable of rotating inside the resonator 50, for generating light as the filled material is excited by the microwave, and a reflector 80 positioned at the circumference of the bulb 60, for reflecting light which is generated from the bulb 60 to the front.

Also, a fan housing 110 installed at the rear side of the casing 10 so that heat generated in the high voltage generator 20 and magnetron 30 is protected, for sucking external air, a cooling fan 100 positioned in the fan housing 110, for sucking external air and a fan motor 101 for rotating the cooling fan 100, are positioned inside the casing 10.

The bulb 60 is positioned at the outer side of the exit 70 which is formed in the waveguide 40 and as shown in FIG. 2, includes a bulb portion 62 which is formed in a globular shape having a filling space 61 therein, and a bulb stem 63 which is lengthened and formed in a rod shape having a predetermined length at a side of the bulb portion 62. The bulb stem 63 is connected to the rotation shaft 91 passing through the waveguide 40 with reference to FIG. 1. The rotation shaft 91 is connected to a bulb motor 90 which is positioned between the fan housing 110 and the waveguide 40.

Therefore, the rotation shaft 91 is rotated by the operation of the bulb motor 90, the bulb is rotated by rotation of the rotation shaft 91 and accordingly, the bulb 60 is cooled.

In the filling space 61 of the bulb 60, primary emission fills which lead light emission by forming plasma in the operation, such as halogen compounds or sulfur (S), Selenium (Se), and the like, inert gas for forming plasma at the initial stage of light emission, such as argon (Ar), Xenon (Xe), Kripton (Kr) and the like and additives for easing lighting by helping initial discharge or adjusting a spectrum of the generated light, are filled in the bulb.

The operation of the electrodeless lighting system will be described.

Firstly, when a power source is applied, a high voltage is generated in the high voltage generator 20 and a microwave is generated in the magnetron 30 by the high voltage impressed.

The microwave generated in the magnetron 30 is transmitted to the resonator 50 through the waveguide 40 and a strong electric field is distributed in the resonator 50. The material which is filled inside the bulb 60 is discharged by the electric field and at the same time, evaporated, thus to generate plasma.

Namely, the inert gas which is filled in the bulb 60 is discharged by a strong electric field distributed inside the resonator 50 and plasma is formed as the main luminous material is evaporated by heat which is generated by discharge of the inert gas. Then, light is emitted maintaining discharging by the microwave which is continuously supplied to the resonator 50.

Also, light which is emitted is reflected by the reflector 80 and thrown forwards.

Simultaneously, as the bulb 60 is rotated by operating the bulb motor 90, the bulb 60 is cooled and an external air flows to the inside of the casing 10 as the cooling fan 100 is rotated by operating the fan motor 101, thus to cooling the high voltage generator 20 and magnetron 30.

However, the conventional electrodeless lighting system has a disadvantage that re-lighting is not directly conducted but in several tens of seconds or several minutes, if the bulb 60 is re-lit after light-out of the bulb 60 under the lighting condition.

The disadvantage is caused since a sufficient mean free path of an electron having energy which is needed for plasma discharging can not be secured as the pressure of the neutral gas which is filled inside the bulb 60 is too high. Particularly, even though 5% of light efficiency is increased in case of using Xenon (Xe) as the inertia gas than in case of using just argon (Ar), discharging becomes more difficult under the condition of high voltage because of the large collision cross section of Xenon (Xe).

On the other hand, as a conventional method for reducing the time required for lighting, the internal pressure of the bulb 60 can be lowered by cooling by directly blowing a strong wind. However, the conventional method caused problems of an increase in the cost for mounting an additional device for blowing the strong wind, reliability of the additional device, utilization of the circumference of the electrodeless lighting system, and light shading which is discharged by the additional devices.

SUMMARY OF THE INVENTION

Therefore, an object of the present invention is to provide an electrodeless lighting system, capable of minimizing the time required for lighting of a bulb.

To achieve these and other advantages and in accordance with the purpose of the present invention, as embodied and broadly described herein, there is provided an electrodeless lighting system, including a waveguide having an outlet which is installed being protruded from the inside of a casing to the outside of the casing, for transmitting a microwave generated in the magnetron, a resonator fixed at the outer side of the outlet of the waveguide, for forming a resonant region in which the microwave is resonated, a bulb for generating light as plasma is generated by an electric field which is formed inside the resonator and a lighting promoting means positioned inside the bulb, for concentrating the electric field so that light is rapidly emitted when the microwave is applied.

Also, the conductive member includes a basic member having a predetermined diameter and length to maintain a physical shape and a conductive layer made by coating a conductive material on the basic member, for concentrating the electric field.

The conductive member of the electrodeless lighting system in accordance with the present invention further includes a protection layer for preventing the conductive member from having a reaction directly with plasma on the conductive layer.

With the electrodeless lighting system in accordance with the present invention, convenience of a user can be achieved and reliability of lighting can be increased, since electric field is concentrated at both ends of the conductive member which is mounted inside the bulb in case of applying a microwave of the bulb by positioning the conductive member in the filling space of the bulb and the bulb can emit light.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
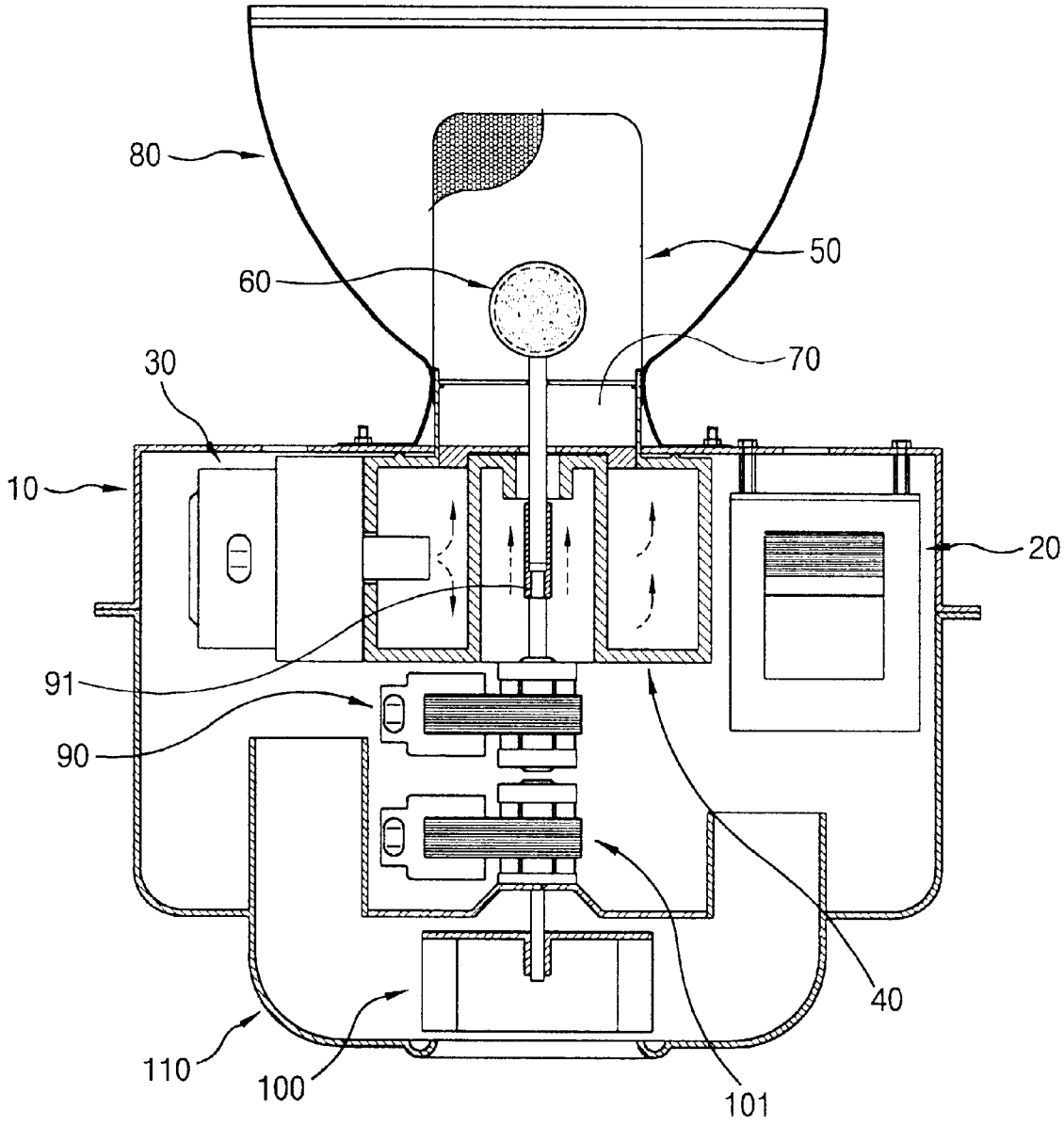
FIG. 1 CONVENTIONAL ART
FIG. 1 is a longitudinal cross-sectional view showing a general electrodeless lighting system according to the conventional art.
Figure 2:
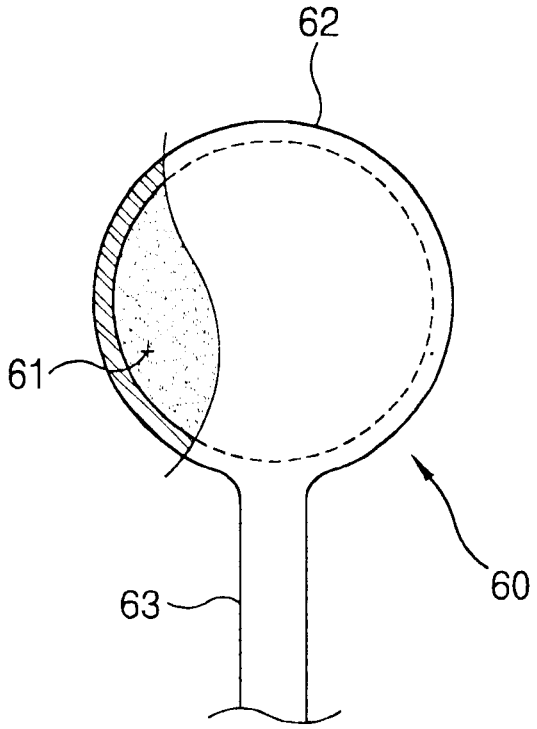
FIG. 2 CONVENTIONAL ART
FIG. 2 is a partial cut-away detailed view of a bulb of the electrodeless lighting system in accordance with the conventional art.
Figure 3:
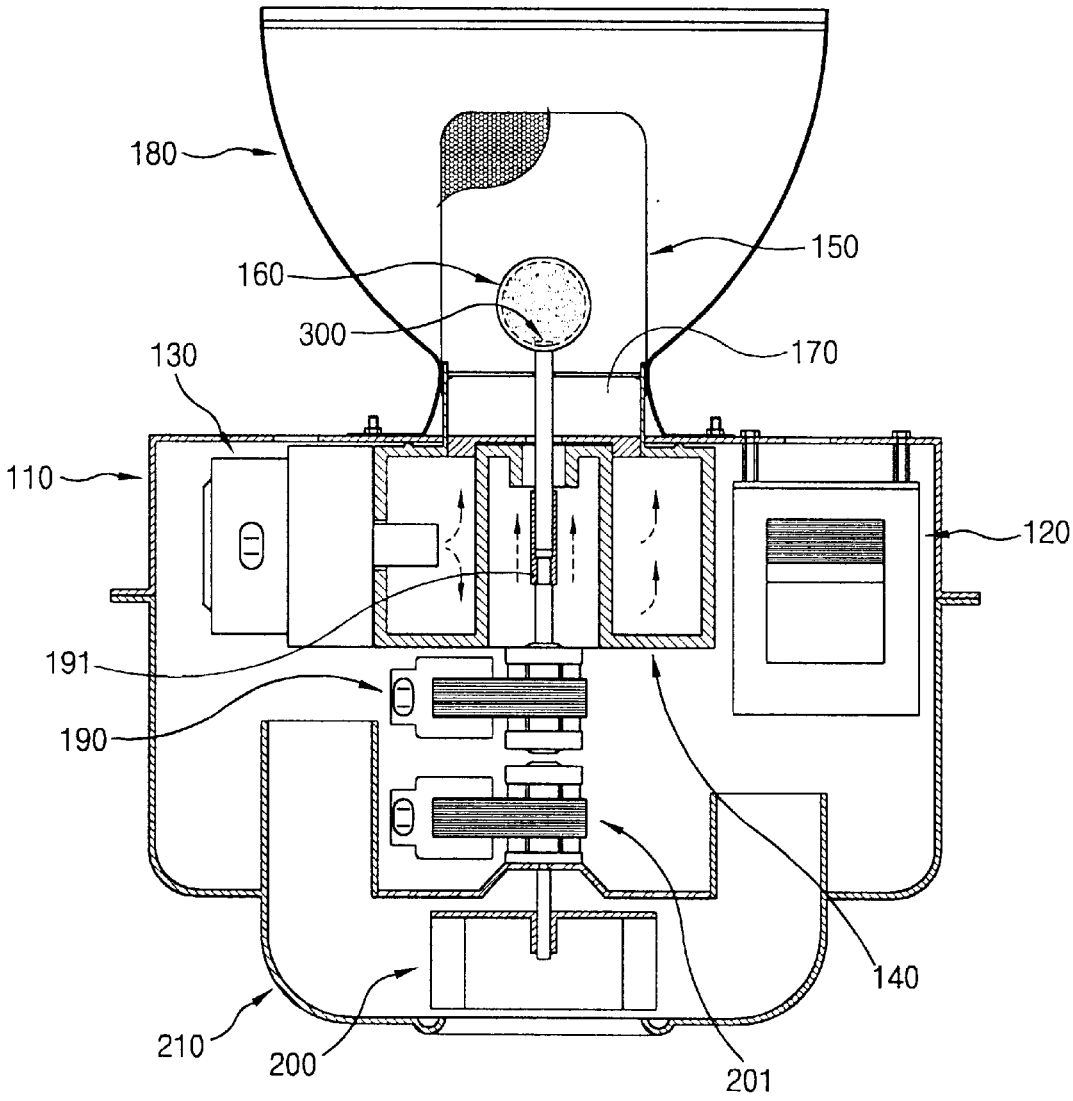
FIG. 3 is a cross-sectional view showing an electrodeless lighting system in accordance with the present invention.
Figure 4:
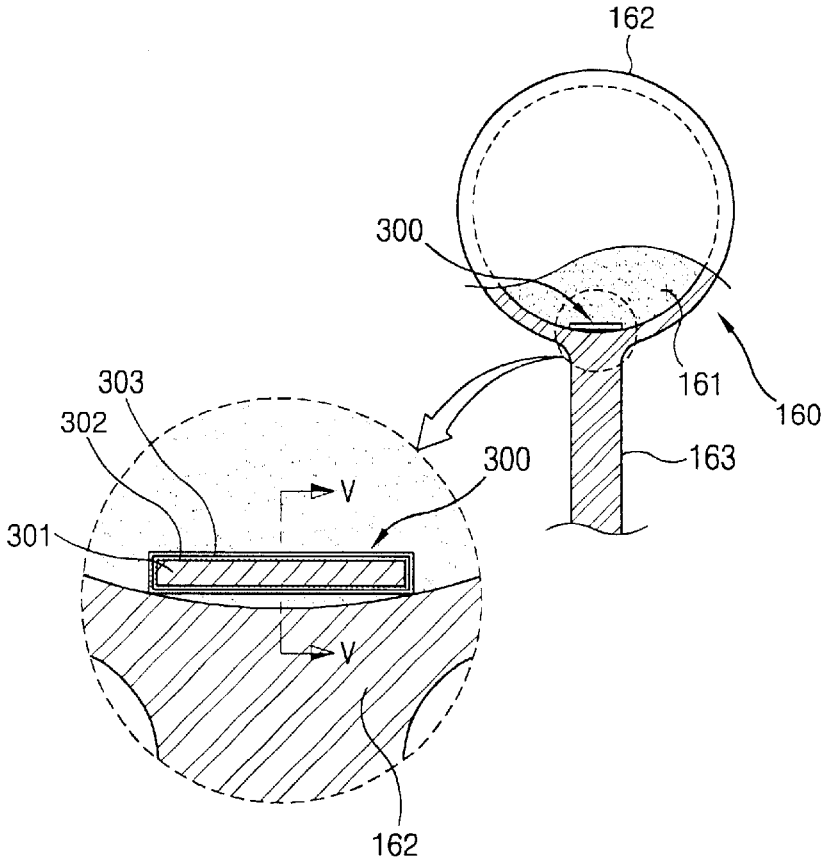
FIG. 4 is a cross-sectional view showing a bulb and conductive member of the electrodeless lighting system in accordance with the present invention.
Figure 5:
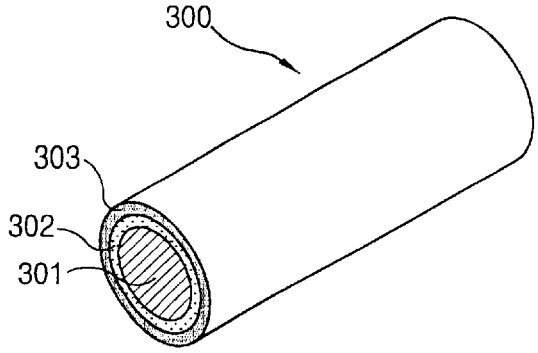
FIG. 5 is a partially cut perspective view showing the conductive member taken along section line V—V of FIG. 4.

FIG. 3 is a cross-sectional view showing an electrodeless lighting system in accordance with the present invention, FIG. 4 is a cross-sectional view showing a bulb and conductive member of the electrodeless lighting system in accordance with an embodiment of the present invention, and FIG. 5 is a partially cut perspective view showing the conductive member taken along section line V—V of FIG. 4.

The conventional electrodeless lighting system includes a casing 110 of a predetermined shape, a high voltage generator 120 positioned on the inner front surface of the casing 110 for generating high voltage, a magnetron 130 positioned at a predetermined interval from the high voltage generator 120, for generating microwave by the high voltage generated in the high voltage generator 120, a waveguide 140 for guiding the microwave generated from the magnetron 130, a resonator 150 installed at the front outer side of the casing so that it is connected with the waveguide 140, for resonating the microwave guided through the waveguide 140 and at the same time, preventing leakage of the microwave to the outside, a bulb 160 mounted to be capable of rotating inside the resonator 150, for generating light as the filled material is excited by the microwave, and a reflector 180 positioned at the circumference of the bulb 160, for reflecting light which is generated from the bulb 160 to the front.

The resonator 150 is formed in a cylindrical shape having a side closed, as a mesh type to intercept leakage of the microwave and pass light generated in the bulb 160.

The bulb 160 is positioned at the outer side of the exit 170 which is formed in the waveguide 140 and as shown in FIG. 4, includes a bulb portion 162 which is formed in a globular shape having a filling space 161 therein, and a bulb stem 163 which is lengthened and formed in a rod shape having a predetermined length at a side of the bulb portion 162. The bulb stem 163 is connected to the rotation shaft 191 passing through the waveguide 140. The rotation shaft 191 is connected to a bulb motor 190 which is positioned between the fan housing 210 and the waveguide 140.

Therefore, the rotation shaft 191 is rotated by the operation of the bulb motor 190, the bulb 160 is rotated by rotation of the rotation shaft 191 and accordingly, the bulb 160 is cooled.

Also, in the filling space 161 of the bulb 160, primary emission fills which lead light emission by forming plasma in the operation, such as halogen compounds or sulfur (S), Selenium (Se), and the like, inert gas for forming plasma at the initial stage of light emission, such as argon (Ar), Xenon (Xe), Kripton (Kr) and the like and additives for easing lighting by helping initial discharge or adjusting a spectrum of the generated light, are filled in the bulb.

A conductive member 300 having conductivity to concentrate an electric field generated when the microwave is applied, is positioned in the filling space 161 of the bulb 160.

As shown in FIG. 5, the conductive member 300 includes a basic member 301 having a predetermined diameter and length to maintain a physical shape and a conductive layer 302 which is coated on the basic member 301 and made of a conductive material to induce concentration of electric field.

Also, a protection layer 303 for preventing degradation by a reaction with plasma, is formed on the conductive layer 302 coated on the basic member 301.

It is desirable that the basic member 301 is made of SiC which is not deformed at high temperature higher than several hundreds of degrees. Also, the conductive layer 302 is made of a metallic material and preferably, made of Pt.

It is desirable that the protection layer 303 is made of materials having thermostability, such as ceramic or fused silica.

The conductive member 300 is formed in a wire type having a diameter of 5 μm and efficiency becomes excellent as the length of the conductive layer 302 is longer than the diameter with the length of the conductive layer 302 of 0.5 μm or shorter. It is desirable that the ratio between the diameter and length is formed smaller than 1/100.

Hereinafter, the operation and effect of the electrodeless lighting system of the present invention will be described as follows.

Firstly, when a power source is applied, a high voltage is generated in the high voltage generator 120 and a microwave is generated in the magnetron 130 by the high voltage generated in the high voltage generator 120.

The microwave generated in the magnetron 130 is transmitted to the resonator 150 through the waveguide 140 and a strong electric field is distributed in the resonator 150. The material which is filled in the filling space 161 of the bulb 160 is discharged by the electric field and at the same time, evaporated, thus to generate plasma.

At this time, the inert gas which is filled in the bulb 160 is discharged by a strong electric field distributed inside the resonator 150 and plasma is formed as the main luminous material is evaporated by heat which is generated by discharge of the inert gas. Then, light is emitted maintaining discharging by the microwave which is continuously supplied to the resonator 150.

Also, light which is emitted is reflected by the reflector 180 and thrown forwards.

On the other hand, when the light of the electrodeless lighting system is re-lit after light-out, concentration phenomenon is occurred at both ends of the conductive member 300 which is inserted in the filling space 161 of the bulb 160 by the microwave and the time required for lighting of the electrode lamp is shortened as the electron which is accelerratively discharged by the strong electric field, eases gas discharging.

Also, lighting characteristic can be easily improved since a conductive member 300 is inserted inside the filling space of the bulb 160.

As described above, in the electrodeless lighting system in accordance with the present invention, the electric field is concentrated at both ends of the conductive member mounted in the bulb and accordingly, the bulb rapidly emits light in case of applying the microwave to the bulb, by positioning a conductive member in the filling space of the bulb, thus to achieve convenience of the user and increase reliability of lighting.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a waveguide, in which an exit is exposed out of a casing, installed in the casing for transmitting a microwave generated in the magnetron;

a resonator fixed at the outer side of the outlet of the waveguide, for forming a resonant region in which the microwave is resonated;

a bulb for generating light as plasma is generated by an electric field which is formed inside the resonator; and a lighting promoting means positioned inside the bulb, for concentrating the electric field so that light is rapidly emitted when the microwave is applied, wherein the lighting promoting means is a conductive member which is formed as a wire and which includes:

a basic member having a predetermined diameter and length to maintain a physical shape; and a conductive layer which is made by coating a conductive material on the basic member, to concentrate an electric field wherein the wire has a diameter of about 5 μm or less.

2. The system of claim 1, wherein the basic member is made of a material which can stand a temperature of several hundred degrees.

3. The system of claim 2, wherein the basic member is made of SiC.

4. The system of claim 1, wherein the conductive layer is made of Pt.

5.The system of claim 1, wherein the conductive member further includes a protection layer for preventing the conductive member from having a reaction directly with plasma on the conductive layer.

6. The system of claim 5, wherein the protection layer is ceramic having thermostability or fused silica.

7. The system of claim 1, wherein the ratio between the diameter and length of the conductive member is smaller than 1/100.

8. A bulb for an electrodeless lighting system in which a filled material is filled to form plasma by a microwave and a lighting promoting means which is formed as a wire for concentrating an electric field is inserted so that light is emitted rapidly when microwave is applied, wherein the lighting promoting means includes:

a basic member having a predetermined diameter and length to maintain a physical shape; and a conductive layer which is made by coating a conductive material on the basic member, to concentrate an electric field wherein the wire has a diameter of about 5 μm or less.

9. The bulb of claim 8, wherein the basic member is composed of a thermostable material.

10. The bulb of claim 9, wherein the basic member is made of SiC.

11. The bulb of claim 8, wherein the conductive layer is made of Pt.

12. The bulb of claim 8, further comprising:

a protection layer for preventing degradation by a reaction with plasma, on the conductive layer of the lighting promoting means.

13. The bulb of claim 8, wherein the protection layer is ceramic having a thermostability or fused silica.

14. The bulb of claim 8, wherein the ratio between the diameter and length of the lighting promoting means is lower than 1/100.

15. A bulb for an electrodeless lighting system in which a filled material is filled to form plasma by a microwave and a lighting promoting means which is formed as a wire and which is composed of a basic member having a predetermined diameter and length, a conductive layer made of a conductive material which is coated on the basic member and a thermostable protection layer which is coated on the conductive layer, the lighting promoting means being inserted in the bulb so that light is emitted rapidly when the microwave is applied, to concentrate an electric field wherein the wire has a diameter of about 5 μm or less.

16. The bulb of claim 15, wherein the basic member is made of Sic, the conductive layer is made of Pt and the protection layer is made of ceramic or fused silica.

* * * * *